United States Patent [19]

Eckenrod et al.

[11] Patent Number: 4,797,252

[45] Date of Patent: Jan. 10, 1989

[54] CORROSION-RESISTANT, LOW-CARBON PLUS NITROGEN AUSTENITIC STAINLESS STEELS WITH IMPROVED MACHINABILITY

[75] Inventors: John J. Eckenrod, Coraopolis; Geoffrey O. Rhodes, Saxonburg; Kenneth E. Pinnow, Pittsburgh, all of Pa.; William E. Royer, Lafayette, N.Y.

[73] Assignee: Crucible Materials Corporation, Pittsburgh, Pa.

[21] Appl. No.: 910,238

[22] Filed: Sep. 19, 1986

[51] Int. Cl.[4] ..... C22C 38/40

[52] U.S. Cl. ..... 420/42; 420/43; 420/52; 148/327

[58] Field of Search ..... 148/327; 420/43, 52, 420/87, 42

[56] References Cited

U.S. PATENT DOCUMENTS

| | | | |
|---|---|---|---|
| 2,685,546 | 8/1954 | Gibb | 148/327 |
| 3,129,120 | 4/1964 | Smith et al. | 148/327 |
| 4,613,367 | 9/1986 | Eckenrod et al. | 420/42 |

FOREIGN PATENT DOCUMENTS

| | | | |
|---|---|---|---|
| 57-207157 | 12/1982 | Japan | 420/52 |
| 872052 | 7/1961 | United Kingdom | 420/52 |

*Primary Examiner*—Deborah Yee

*Attorney, Agent, or Firm*—Finnegan, Henderson, Farabow, Garrett & Dunner

[57] ABSTRACT

A free-machining, austenitic stainless steel having low carbon plug nitrogen contents in combination with manganese and sulfur additions. The steel may have silicon of 0.045 to 1.00 percent.

16 Claims, No Drawings

CORROSION-RESISTANT, LOW-CARBON PLUS NITROGEN AUSTENITIC STAINLESS STEELS WITH IMPROVED MACHINABILITY

BACKGROUND OF THE INVENTION

The austenitic chromium-nickel and chromium-nickel- molybdenum stainless steels are used in a variety of corrosion-resistant parts and fittings. The manufacture of many of these parts and fittings requires considerable machining, and thus the machinability as well as the corrosion resistance of these austenitic stainless steels is an important factor affecting their use in these applications.

It is well known that the machinability of the chromium-nickel and chromium-nickel-molybdenum stainless steels can be improved by the addition of sulfur, selenium, tellurium, bismuth, lead, and phosphorus. However, the addition of sulfur and of these other elements adversely affects corrosion resistance and the ability of these stainless steels to be continuously cast or hot worked without undue difficulty.

Efforts have been made to improve the machinability of the austenitic stainless steels without sacrificing corrosion resistance by adding small amounts of sulfur to achieve the greatest possible improvement in machinability without unduly reducing corrosion resistance. In this regard, U.S. Pat. No. 3,563,729 discloses that austenitic stainless steels having improved machinability without a notable sacrifice in corrosion resistance can be achieved by the addition of 0.04 to 0.07 percent sulfur. While such austenitic stainless steels are very useful, many applications exist where the combination of machinability and corrosion resistance afforded by them is not satisfactory, and where still better machinability is desired without a decrease in corrosion resistance. Further, as with other sulfur-bearing austenitic stainless steels, they suffer from the disadvantage that when continuously cast their machinability is adversely affected by the tendency of this casting technique to produce more numerous and smaller sulfide inclusions than achieved by conventional ingot casting.

It has now been discovered that the machinability of the austenitic chromium-nickel and chromium-nickel-molybdenum stainless steels with either low or slightly elevated sulfur contents can be improved by maintaining carbon and nitrogen, in combination, at lower than conventional levels and by controlling silicon at an optimum level. An important advantage of this discovery is that machinability can be improved without a decrease in corrosion resistance. Further, in contrast to those austenitic stainless steels in which sulfur is the primary agent used to improve machinability, the steels of this invention can be continuously cast without difficulty and without significantly decreasing their machinability.

OBJECTS OF THE INVENTION

It is accordingly a primary object of the present invention to provide austenitic stainless steels having improved machining characteristics without adversely affecting corrosion resistance.

It is a more specific object of the present invention to provide austenitic stainless steels wherein carbon and nitrogen, and in which silicon is maintained at an optimum level, which with either low or slightly elevated sulfur contents results in improved machinability without adversely affecting corrosion resistance.

A still further object of the present invention is to provide wrought, continuously cast austenitic stainless steel products having improved machining characteristics without adversely affecting their corrosion resistance.

Yet another object of this invention is to provide wrought, continuously cast austenitic stainless steel products wherein carbon and nitrogen, in combination, are maintained at lower than conventional levels and in which silicon is maintained at an optimum level, which with either low or slightly elevated sulfur contents results in improved machinability without adversely affecting corrosion resistance.

SUMMARY OF THE INVENTION

Broadly in accordance with the present invention, the machinability of austenitic chromium-nickel and chromium-nickel-molybdenum stainless steels with either low or slightly elevated sulfur contents is improved by reducing their total carbon plus nitrogen contents below conventional levels and by optimizing the silicon content. In this regard, the total carbon plus nitrogen in combination at low levels in accordance with this invention is more effective in improving machinability than either low carbon or nitrogen alone, Further, the austenitic stainless steels of this invention have particular advantage as continuously cast and wrought products, since in contrast to prior art steels of this type, they can be continuously cast without difficulty and more importantly without a significant decrease in machinability.

The chemical compositions of the austenitic stainless steels, and the continuously cast and wrought products of this invention are within the following limits, in weight percent:

- Carbon plus nitrogen total—up to about 0.070, and preferably about 0.052 or 0.040.
- Chromium 16 to 20, preferably 18 to 20 when up to 1.0 molybdenum is present or 16 to 18 when 2.0 to 3.0 molybdenum is present.
- Nickel—8 to 14, preferably 8 to 12 when up to 1.0 molybdenum is present or 10 to 14 when 2.0 to 3.0 molybdenum is present.
- Sulfur—0.02 to about 0.07, preferably up to 0.04 for optimum corrosion resistance or 0.04 to 0.07 for optimum machinability.
- Manganese—up to 2.0.
- Silicon—up to 1.0, preferably 0.45 to 0.75.
- Phosphorus—up to 0.05.
- Molybdenus—up to 3.0, preferably up to 1.0 for lowest cost, or 2.0 to 3.0 for optimum corrosion resistance.
- Copper—up to 1.0
- Iron—balance, except for incidental impurities and up to 0.01 boron which may be added to improve hot workability.

DETAILED DESCRIPTION OF THE PREFERRED EMBODIMENTS

To demonstrate the invention, and specifically the limits with respect to carbon plus nitrogen and silicon contents, ten 50-pound vacuum induction heats were melted and cast into ingots. The ingots were heated to 2250° F., forged to 1 3/16 inch hexagonal bars, air cooled to ambient temperature, then annealed at 1950° F. for ½-hour, water quenched and lathe turned to 1-inch rounds. The chemical compositions of the experimental heats are shown in Table I.

TABLE I

| Heat Number | Chemical Composition of Experimental Steels* WEIGHT PERCENT | | | | | | | | | | |
|---|---|---|---|---|---|---|---|---|---|---|---|
| | C | Mn | P | S | Si | Ni | Cr | Mo | Cu | N | C + N |
| V550 | 0.003 | 1.71 | 0.034 | 0.028 | 0.53 | 11.23 | 16.98 | 2.11 | 0.29 | 0.002 | 0.005 |
| V472A | 0.020 | 1.65 | 0.032 | 0.028 | 0.50 | 10.96 | 16.77 | 2.11 | 0.29 | 0.020 | 0.040 |
| V475 | 0.017 | 1.68 | 0.029 | 0.030 | 0.29 | 11.24 | 16.68 | 2.09 | 0.29 | 0.028 | 0.045 |
| V477 | 0.024 | 1.68 | 0.032 | 0.028 | 0.62 | 11.04 | 16.98 | 2.11 | 0.30 | 0.022 | 0.046 |
| V476 | 0.021 | 1.67 | 0.031 | 0.026 | 0.45 | 11.16 | 16.96 | 2.09 | 0.29 | 0.031 | 0.052 |
| V606 | 0.019 | 1.75 | 0.030 | 0.027 | 0.84 | 10.97 | 16.88 | 2.09 | 0.30 | 0.033 | 0.052 |
| V472 | 0.023 | 1.71 | 0.032 | 0.033 | 0.53 | 11.12 | 16.75 | 2.09 | 0.29 | 0.041 | 0.064 |
| V473 | 0.030 | 1.66 | 0.032 | 0.029 | 0.53 | 11.04 | 16.84 | 2.09 | 0.29 | 0.040 | 0.070 |
| V474 | 0.040 | 1.67 | 0.031 | 0.028 | 0.47 | 11.00 | 16.69 | 2.09 | 0.30 | 0.055 | 0.095 |
| V558 | 0.025 | 1.75 | 0.030 | 0.032 | 0.57 | 10.92 | 16.79 | 2.10 | 0.30 | 0.094 | 0.119 |

*Balance iron and incidental impurities.

Metallographic evaluations were conducted on representative specimens taken from an annealed bar forged from each ingot. No ferrite was detected in any of the steels using metallographic or magnetic techniques. The sulfide inclusions in each heat were similar and were predominantly globular manganese sulfide inclusions, some of which were partially surrounded with a silicate type oxide. Some stringer type manganese sulfide incusions associated with silicate type oxides were also observed in the heats with silicon contents of over 0.45%. In the low-silicon heats V475 (0.29% Si) and V476 (0.45% Si), both manganese chromium spinel and silicate type oxides were observed. Heat V476 contained primarily silicate type oxide inclusions, but heat V475 contained primarily spinels. In the high-silicon heat V606 (0.84% Si), both silicate and silica type oxide inclusions were observed.

Machinability evaluations were conducted by subjecting annealed one-inch round bars of the experimental heats to a lubricated plunge-cut lathe turning test at machining speeds from 160 to 180 surface feet per minute (sfm). In the plunge-cut test, the relative machining characteristics of the test materials are established by the number of approximately ¼-inch thick wafers that are cut from the test steel at various machining speeds prior to catastrophic failure of the cutting tool. The results of the plunge-cut testing of these experimental steels and the testing parameters are set forth in Table II.

TABLE II

Results of Lubricated Lathe Cut-Off-Tool-Life Testing of Experimental Steels

| | Heat Number | Composition % C + N | Composition % Si | Wafer Cuts at Indicated Machining Speeds (sfm) 180 | 170 | 160 |
|---|---|---|---|---|---|---|
| Variable Silicon | V475 | 0.045 | 0.29 | 7 | 10 | 12 |
| | V476 | 0.052 | 0.45 | 8 | 13 | 20 |
| | V477 | 0.046 | 0.62 | 9 | 19 | 33 |
| | V606 | 0.052 | 0.84 | 8 | 13 | 19 |
| Low Carbon Plus Nitrogen | V550 | 0.005 | 0.53 | 13 | 20 | 36 |
| | V472A | 0.040 | 0.50 | 10 | 17 | 32 |
| | V472 | 0.064 | 0.53 | 8 | 12 | 24 |
| | V473 | 0.070 | 0.53 | 8 | 11 | 23 |
| High Carbon Plus Nitrogen | V474 | 0.095 | 0.47 | — | 4 | 8 |
| | V558 | 0.119 | 0.57 | — | 6 | 11 |

Testing Parameters

| | |
|---|---|
| Materials: | 1 inch diameter bar |
| Tools: | ¼ inch flat blade M2 tool steel<br>14° from clearance angle<br>3° side clearance angle |

TABLE II-continued

Results of Lubricated Lathe Cut-Off-Tool-Life Testing of Experimental Steels

| | |
|---|---|
| | 0° top rake angle<br>0° cutting angle |
| Feed Rate: | 0.002 inches per revolution |
| Lubrication: | 2 parts dark thread cutting oil plus 3 parts kerosene |

As can be seen in Table II, the number of wafers cut prior to tool failure varied widely with the carbon plus nitrogen and silicon contents of the experimental steels. At a cutting speed of 160 sfm, 8 to 11 wafers could be cut from heats V474 and V558, both having carbon plus nitrogen contents outside the limits of this invention. More wafers could be cut from the stainless steels having carbon plus nitrogen contents within the limits of this invention. The cut-off-tool-life test results also show that it is not necessary to have extremely low carbon plus nitrogen contents to achieve improved machinability. At 160 sfm, heat V550 containing 0.005% carbon plus nitrogen produced 36 wafers; whereas, heat V472A having 0.040% carbon plus nitrogen produced 32 wafers. Manufacturing a 0.005% carbon plus nitrogen steel similar to heat V550 would require a special and expensive melting and refining process; whereas, the 0.040% carbon plus nitrogen content of heat V472A can be achieved by state-of-the-art melting and refining techniques.

The effect of silicon content on machinability is clearly shown by the data in Table II for heats V475, V476, V477, and V606 which contain 0.29, 0.45, 0.62, and 0.84% silicon, respectively, and about the same sulfur and carbon plus nitrogen contents. At a cutting speed of 160 sfm, the number of wafers that can be cut from these steels increases signficantly with an increase in silicon content from 0.29 to 0.62% and then decreases as silicon content is further increased from 0.62 to 0.85%. Based on the number of wafers cut at this testing speed, the silicon contents makrng for best machinability range from about 0.45 to 0.75%.

The variations in machinability with silicon content are believed to relate to the type of oxides present in the steel. The silicon-steel-oxygen equilibrium system in these steels is balanced such that at low silicon contents the manganese chromium spinel type of oxide is formed; whereas, at moderate silicon contents the silicate type oxide is formed; and at higher silicon contents the silica type oxide is formed, provided no other strong deoxidizing elements such as titanium or aluminum are present in the steel. At machining temperatures, the spinel type oxides maintain their angularity and are harder than the machining tool thus causing tool wear. Conversely, the rounded silicate type oxides exhibit decreased hardness and high plasticity at machining temperatures, thus causing less wear to the machining tool than do the spinel type oxides. The silica type oxides are also rounded, but like the spinel type oxides are harder than the machining tool at machining temperatures and thus cause more tool wear than the silicate type oxiees.

To further clarify the effects of carbon plus nitrogen and silicon content on the machinability of the steels of this invention, a multiple linear regression analysis was conducted on the lubricated lathe cut-off-tool-life test results at 160 sfm using the heats within the preferred range of silicon (0.45 to 0.75%). The resulting equation, wafer cuts at 160 sfm=5–270 (% C+N)+67 (% Si), indicates that on an equivalent weight percent basis, the carbon plus nitrogen content of the experimental steels has approximately 4 times greater influence on the number of wafers cut at a machining speed of 160 sfm than does the silicon content. To better clarify the effect of carbon plus nitrogen content on machinability, the lubricated lathe cut-off-tool-life results at a machinnng speed of 160 sfm were corrected for variations in the silicon contents of the experimental steels by using the silicon coefficient of the multiple linear regression equation, and using a nominal silicon content of 0.53% as the standard silicon content.

TABLE III

Lubricated Lathe Cut-Off-Tool-Life Test Results at a Machining Speed of 160 Surface Feet Per Minute; Corrected for Variations in the Silicon Contents of the Experimental Steels

| Heat Number | % C + N | % Si | Wafer Cuts at 160 sfm Corrected for Variations in Silicon Content* |
|---|---|---|---|
| V550 | 0.005 | 0.53 | 36 |
| V472A | 0.040 | 0.50 | 34 |
| V477 | 0.046 | 0.62 | 27 |
| V476 | 0.052 | 0.45 | 25 |
| V472 | 0.064 | 0.53 | 24 |
| V473 | 0.070 | 0.53 | 23 |
| V474 | 0.095 | 0.47 | 12 |
| V558 | 0.119 | 0.57 | 8 |

*Corrected Wafer Cuts − Actual Wafer Cuts + 67 (0.53 − % Si)

As shown in Table III, the resulting corrected wafer cuts at a machining speed of 160 sfm clearly indicate improved machinability with decreasing carbon plus nitrogen contents. For example, heat V473 with 0.070% carbon plus nitrogen provides a silicon corrected value of 23 wafer cuts, heat V476 with 0.053% carbon plus nitrogen provides a silicon corrected value of 25 wafer cuts, and heat V472A with 0.040% carbon plus nitrogen provides a silicon corrected value of 34 wafer cuts.

What is claimed is:

1. A corrosion resistance fully austenitic stainless steel having improved machinability consisting essntially of, in weight percent, carbon plus nitrogen up to about 0.052, chromium 16 to 20, nickel 8 to 12, sulfur 0.026 to 0.07, manganese up to 2.0, silicon up to 1.0, phosphorus up to 0.05, molybdenum up to 3.0, copper up to 1.0 and the balance iron with incidental impurities.

2. The steel of claim 1 having silicon 0.45 to 0.75.

3. The steel of claim 1 having silicon 0.45 to 0.75 and sulfur 0.04 and 0.07.

4. The steels of claims 2 or 3 having carbon plus nitrogen up to 0.040.

5. The steels of claims 1, 2 or 3 having chromium 18 to 20 and molybdenum up to 1.0.

6. The steels of claims 1, 2 or 3 having chromium 16 to 18 and molybdenum 2 to 3.

7. The steel of claim 4 having chromium 18 to 20 and molybdenum up to 1.0.

8. The steel of claim 4 having chromium 16 to 18, and molybdenum 2 to 3.

9. A continuously cast and wrought fully austenitic stainless steel product having improved machinability consisting essentially of, in weight percent, carbon plus nitrogen up to 0.052, chromium 16 to 20, nickel 8 to 12, sulfur 0.02 to 0.07, manganese up to 2.0, silicon up to 1.0, phosphorus up to 0.05, molybdenum up to 3.0, copper up to 1.0, and the balance iron and incidental impurities.

10. The austenitic stainless steel product of claim 9 having silicon 0.45 to 0.75.

11. The austenitic stainless steel product of claim 9 having silicon 0.45 to 0.75.

12. The austenitic stainless steel product of claim 10 or 11 having carbon plus nitrogen up to 0.040.

13. The austenitic stainless steel product of claims 9, 10 or 11 having chromium 18 to 20 and molybdenum up to 1.0.

14. The austenitic stainless steel product of claims 9, 10 or 11 having chromium 16 to 18 and molybdenum 2 to 3.

15. The austenitic stainless steel product of claim 12 having chromium 18 to 20 and molybdenum up to 1.0.

16. The austenitic stainless steel product of claim 12 havingchromium 16 to 18 and molybdenum 2 to 3.

* * * * *

UNITED STATES PATENT AND TRADEMARK OFFICE

CERTIFICATE OF CORRECTION

PATENT NO. : 4,797,252

DATED : January 10, 1989

INVENTOR(S) : John J. Eckenrod, et al.

It is certified that error appears in the above-identified patent and that said Letters Patent is hereby corrected as shown below:

In the abstract line 2, change "plug" to --plus--;

Col. 4, line 56, change "makrng" to --making--.

Col. 5, line 8, change "oxiees" to --oxides--

Col. 5, line 22, change "machinnng" to --machining--

Claim 1, line 5, change "essn" to --essen- --

Claim 2, line 12, after "0.75" insert --sulfur 0.026 to 0.04--.

Claim 16, line 49, change "havingchromium" to --having chromium--;

Signed and Sealed this

Twentieth Day of November, 1990

*Attest:*

*Attesting Officer*

HARRY F. MANBECK, JR.

*Commissioner of Patents and Trademarks*